US012404737B1

(12) United States Patent
Berry

(10) Patent No.: US 12,404,737 B1
(45) Date of Patent: Sep. 2, 2025

(54) WELL INTERVENTION DISCONNECTION SYSTEM

(71) Applicant: OneSubsea IP UK Limited, London (GB)

(72) Inventor: Cameron Berry, Portlethen (GB)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 18/798,006

(22) Filed: Aug. 8, 2024

(51) Int. Cl.
*E21B 33/035* (2006.01)
*E21B 33/076* (2006.01)

(52) U.S. Cl.
CPC ..... *E21B 33/076* (2013.01); *E21B 33/0355* (2013.01)

(58) Field of Classification Search
CPC ..... E21B 33/0355; E21B 33/076
See application file for complete search history.

(56) References Cited

U.S. PATENT DOCUMENTS 8,181,704 B2 * 5/2012 Fenton ..... E21B 17/06 166/344
9,574,420 B2 * 2/2017 Hall ..... E21B 17/20

* cited by examiner

*Primary Examiner* — Matthew R Buck
(74) *Attorney, Agent, or Firm* — Jeffrey D. Frantz

(57) ABSTRACT

An intervention system is provided for a subsea well operation. The intervention system includes a first coupling portion, a second coupling portion releasably coupled to the first coupling portion, a monitor tether coupled to one of the first coupling portion and the second coupling portion, and a control system. The first coupling portion and the second coupling portion provide fluid communication while the first coupling portion and the second coupling portion are connected to one another. The monitor tether transmits an electrical current while the first coupling portion and the second coupling portion are connected to one another. The control system is operable to detect a change in current in the monitor tether indicative of disconnection between the first coupling portion and the second coupling portion, and, in response to detecting a change in current in the monitor tether indicative of disconnection, interrupt fluid flow relative to the subsea well.

19 Claims, 8 Drawing Sheets

WELL INTERVENTION DISCONNECTION SYSTEM

TECHNICAL FIELD

The present disclosure relates to offshore subsea operations, and more particularly to a disconnection system for subsea wells or tie in points.

BACKGROUND

Operation of subsea drilling and intervention systems may include a disconnect system to selectively detach subsea equipment from equipment (e.g., a tree) located proximate a subsea well. Flow to/from a well may be interrupted when a disconnect event occurs. The disconnection may protect the environment and/or the drilling or intervention equipment.

SUMMARY

In one independent aspect, an intervention system is provided for a subsea well operation. The intervention system includes a first coupling portion, a second coupling portion releasably coupled to the first coupling portion, a monitor tether coupled to one of the first coupling portion and the second coupling portion, and a control system. The first coupling portion and the second coupling portion are configured to provide communication between a vessel and a subsea well while the first coupling portion and the second coupling portion are connected to one another. The monitor tether is configured to transmit an electrical current while the first coupling portion and the second coupling portion are connected to one another. The control system is operable to detect a change in current in the monitor tether indicative of disconnection between the first coupling portion and the second coupling portion, and, in response to detecting a change in current in the monitor tether indicative of disconnection, interrupt fluid flow relative to the subsea well.

In some aspects, the control system is configured to be positioned on a subsea safety module, wherein the monitor tether is configured to be coupled between the subsea safety module and the one of the first coupling portion and the second coupling portion.

In some aspects, the system further includes a switch operable between an open state and a closed state, wherein the switch is in closed state while the first coupling portion and the second coupling portion are connected to one another, and the switch is in the open state while the first coupling portion and the second coupling portion are disconnected from one another, wherein electrical current is prevented from passing through the monitor tether while the switch is in the open state.

In some aspects, the switch includes a first switch portion positioned on the first coupling portion and a second switch portion positioned on the second coupling portion, wherein the switch is in the closed state while the first switch portion and the second switch portion are in contact with one another.

In some aspects, the monitor tether is removably coupled to a portion of the switch.

In some aspects, the monitor tether is removably coupled to the control system.

In some aspects, in response to detecting a change in current indicative of disconnection between the first coupling portion and the second coupling portion, the control system is operable to actuate a valve to prevent at least one of flow into the well and flow out of the well.

In another independent aspect, an intervention system is provided for a subsea well operation. The subsea well operation including a conduit providing communication between a surface vessel and a subsea tree. The intervention system includes a releasable coupling configured to selectively interrupt fluid communication in the conduit, and a sensor for detecting the condition of the releasable coupling. The releasable coupling includes a first coupling portion and a second coupling portion. The first coupling portion is configured to be coupled to a first portion of the conduit, and the second coupling portion is configured to be coupled to a second portion of the conduit. The second coupling portion is movable between a first condition in which the second coupling portion is coupled to the first coupling portion, and a second condition in which the second coupling portion is separated from the first coupling portion. The sensor transmits a signal indicative of the condition of the second coupling portion.

In some aspects, the sensor includes a switch operable between an open state and a closed state, the switch being in closed state while the first coupling portion and the second coupling portion are connected to one another, and the switch is in the open state while the first coupling portion and the second coupling portion are disconnected from one another.

In some aspects, the switch includes a first switch portion positioned on the first coupling portion and a second switch portion positioned on the second coupling portion, wherein the switch is in the closed state while the first switch portion and the second switch portion are in contact with one another.

In some aspects, the system further includes a control system operable to determine, based on the signal indicative of the condition of the second coupling portion, whether the second coupling portion is disconnected from the first coupling portion, and in response to determining that the second coupling portion is disconnected from the first coupling portion, interrupt fluid flow through the conduit.

In some aspects, the sensor transmits the signal via wireless communication.

In some aspects, the sensor transmits the signal via a monitor tether for providing electrical communication between the sensor and a subsea safety module.

In some aspects, the system further includes a mechanical tether including a first end coupled to the first coupling portion and a second end configured to be coupled to a subsea safety module.

In yet another independent aspect, an intervention system is provided for a subsea well operation. The subsea well operation includes a conduit providing communication between a surface vessel and a subsea tree. The intervention system includes a releasable coupling configured to selectively interrupt fluid communication in the conduit, a sensor for detecting the condition of the releasable coupling, a mechanical tether, and a monitor tether coupled to one of the first coupling portion and the second coupling portion. The releasable coupling includes a first coupling portion and a second coupling portion. The first coupling portion is configured to be coupled to a first portion of the conduit, and the second coupling portion is configured to be coupled to a second portion of the conduit. The second coupling portion is movable between a first condition in which the second coupling portion is coupled to the first coupling portion, and a second condition in which the second coupling portion is separated from the first coupling portion.

The mechanical tether includes a first end coupled to the first coupling portion and a second end configured to be coupled to a subsea safety module. The monitor tether is configured to transmit an electrical current while the first coupling portion and the second coupling portion are connected to one another.

In some aspects, the sensor includes a switch operable between an open state and a closed state, the switch being in closed state while the first coupling portion and the second coupling portion are connected to one another, and the switch is in the open state while the first coupling portion and the second coupling portion are disconnected from one another.

In some aspects, the switch includes a first switch portion positioned on the first coupling portion and a second switch portion positioned on the second coupling portion, wherein the switch is in the closed state while the first switch portion and the second switch portion are in contact with one another.

In some aspects, the first coupling portion is positioned on a portion of the conduit coupled to the subsea tree, and the second coupling portion is positioned on a portion of the conduit coupled to the vessel, wherein the monitor tether includes one end coupled to the first coupling portion.

In some aspects, the first coupling portion is positioned on a portion of the conduit coupled to the subsea tree, and the second coupling portion is positioned on a portion of the conduit coupled to the vessel, wherein the monitor tether includes one end coupled to the second coupling portion, wherein another end of the monitor tether is configured to be removably coupled to a subsea safety module.

In some aspects, the monitor tether is longer than the mechanical tether.

BRIEF DESCRIPTION OF THE DRAWINGS

The subject disclosure is further described in the following detailed description, and the accompanying drawings and schematics of non-limiting embodiments of the subject disclosure. The features depicted in the figures are not necessarily shown to scale. Certain features of the embodiments may be shown exaggerated in scale or in somewhat schematic form, and some details of elements may not be shown in the interest of clarity and conciseness. These and other features, aspects, and advantages of the present invention will become better understood when the following detailed description is read with reference to the accompanying drawings in which like characters represent like parts throughout the drawings, wherein.

DETAILED DESCRIPTION

Before any embodiments are explained in detail, it is to be understood that the disclosure is not limited in its application to the details of the configuration and arrangement of components set forth in the following description or illustrated in the accompanying drawings. The disclosure is capable of being practiced or of being carried out in various ways. Also, it is to be understood that the phraseology and terminology used herein are for the purpose of description and should not be regarded as limiting. The use of "including," "comprising," or "having" and variations thereof are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

Figure 1:
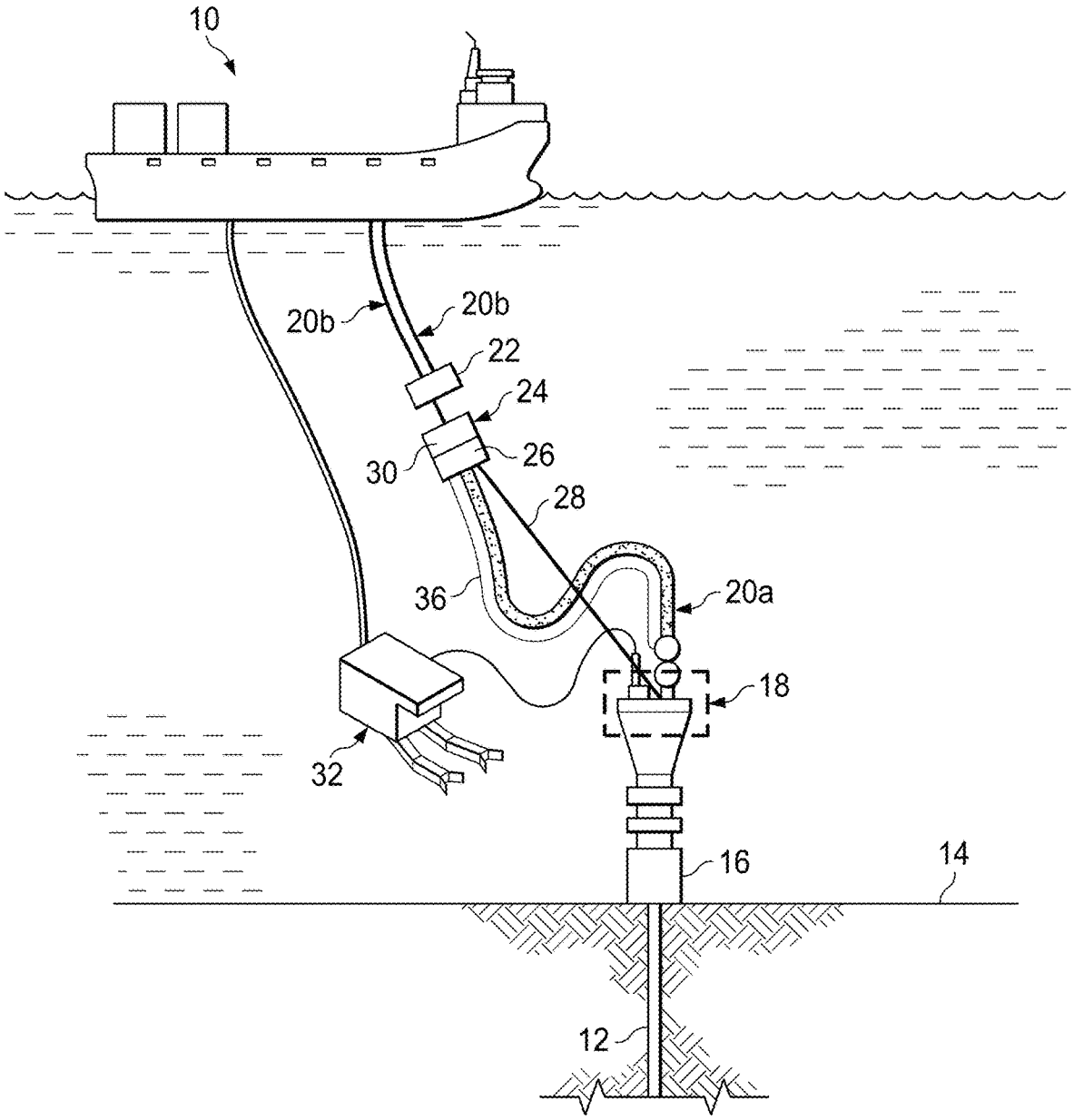
FIG. 1 illustrates a schematic view of a subsea intervention operation.

FIG. 1 depicts a subsea intervention operation, including a vessel 10 (e.g., a surface vessel) positioned substantially above a wellbore 12 positioned on a seafloor 14. A well structure (e.g., tree 16) is positioned above the seafloor 14 (e.g., at the mouth of the wellbore 12) and includes an assembly of valves, spools, and fittings designed to control the flow of fluids into and/or out of the well. A safety module 18 may be integrated with or operably connected to the tree 16. The safety module 18 is configured to perform important safety functions, such as blowout prevention and initiating emergency shutdown (e.g., in response to unsafe conditions).

One or more conduits 20 may connect or provide fluid communication between the vessel 10 or equipment aboard the vessel 10 and the wellbore 12 or equipment proximate to the wellbore 12. The conduits 20 may be provided in the form of coiled tubing or may be provided in other forms. A manifold 22 may separate, consolidate, and/or redistribute flows from the wellbore 12 and/or other wellbores 12 in the vicinity (not shown) may be in fluid communication with one or more conduits 20. In the illustrated embodiment of FIG. 1, a primary conduit 20*a* may extend between the tree 16 (e.g., the primary conduit 20*a* may have an end connected to the safety module 18) and the manifold 22, and two or more secondary conduits 20*b* may extend between the manifold 22 and the vessel 10 or equipment aboard the vessel 10. In other embodiments, other configurations may include a different number of wellbores 12, conduits 20, and/or manifolds 22.

A disconnect system 24 is operable to rapidly detach subsea equipment (e.g., the manifold 22, conduits 20*a*, 20*b*, etc.) from the safety module 18 and/or other equipment proximate the wellbore 12. In the illustrated embodiment, the disconnect system 24 is positioned at an intermediate location along the primary conduit 20*a*. For example, the disconnect system 24 may be a mid-line weak link (MLWL) providing a predetermined point of failure/disconnection along the load path between the vessel 10 and the wellbore 12. The disconnect system 24 may facilitate disconnection in response to a certain condition (e.g., tension in the conduit 20*a* exceeding a predetermined threshold) to avoid damage to various components of the operation. In this way, the disconnect system 24 protects the integrity of the rest of the system.

Figure 2A:
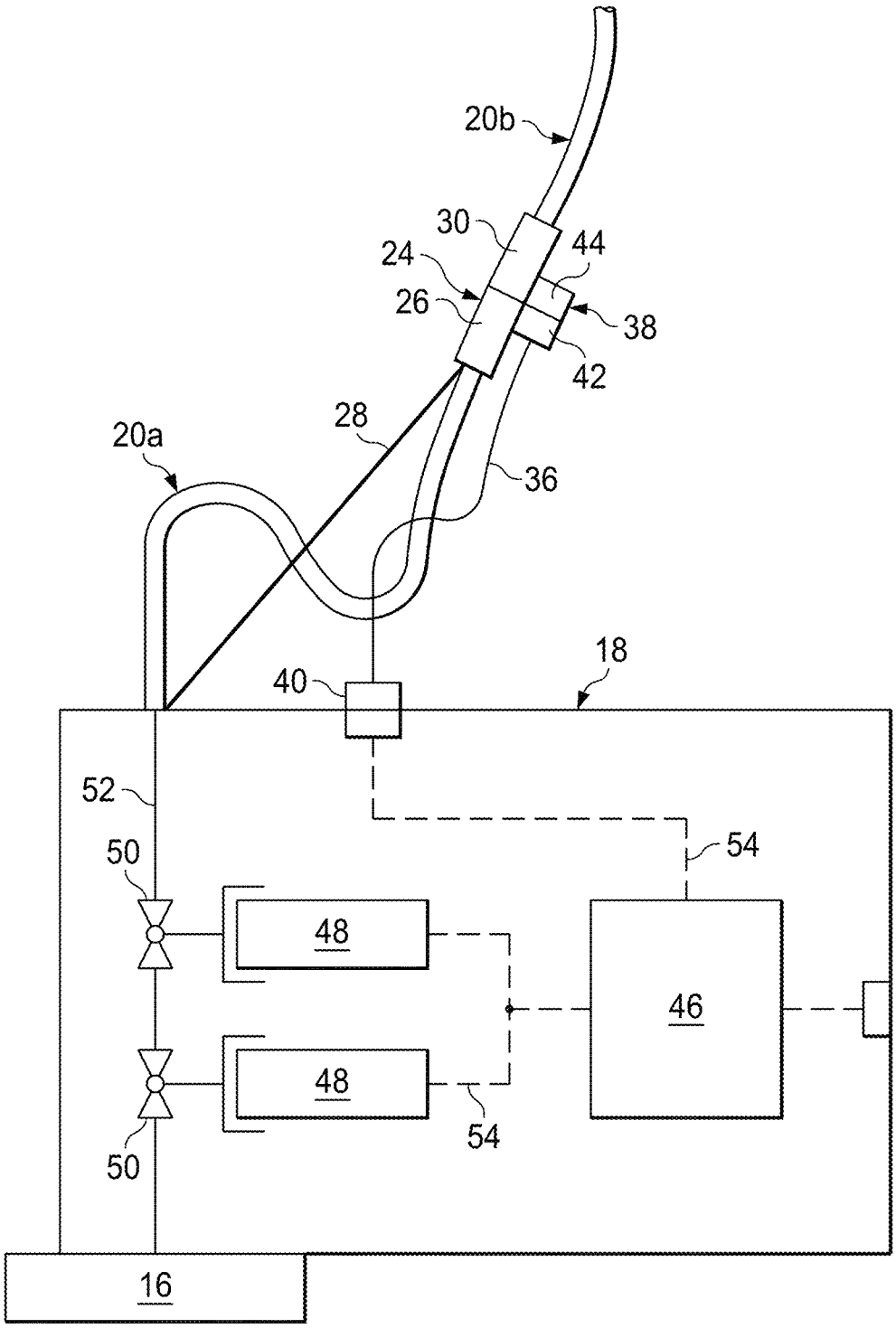
FIG. 2A illustrates a schematic view of a well intervention system according to one embodiment, with a disconnect system in a connected state.

As shown in FIG. 2A, in the illustrated embodiment, the disconnect system 24 may include a first or lower coupling portion 26 connected to the tree 16 (for example, via the safety module 18) and a second or upper coupling portion 30 releasably coupled to the lower coupling portion 26. The lower coupling portion 26 may be coupled to the safety module by a mechanical tether 28. In some embodiments, the mechanical tether 28 is a flexible connector (e.g., a cable) that may provide high tensile strength and is resistant to fatigue and corrosion. In some embodiments, the mechanical tether 28 may be formed from metallic wire, synthetic fiber (e.g., polyester, nylon, etc.), Kevlar and aramid fibers, and/or other materials.

Figure 2B:
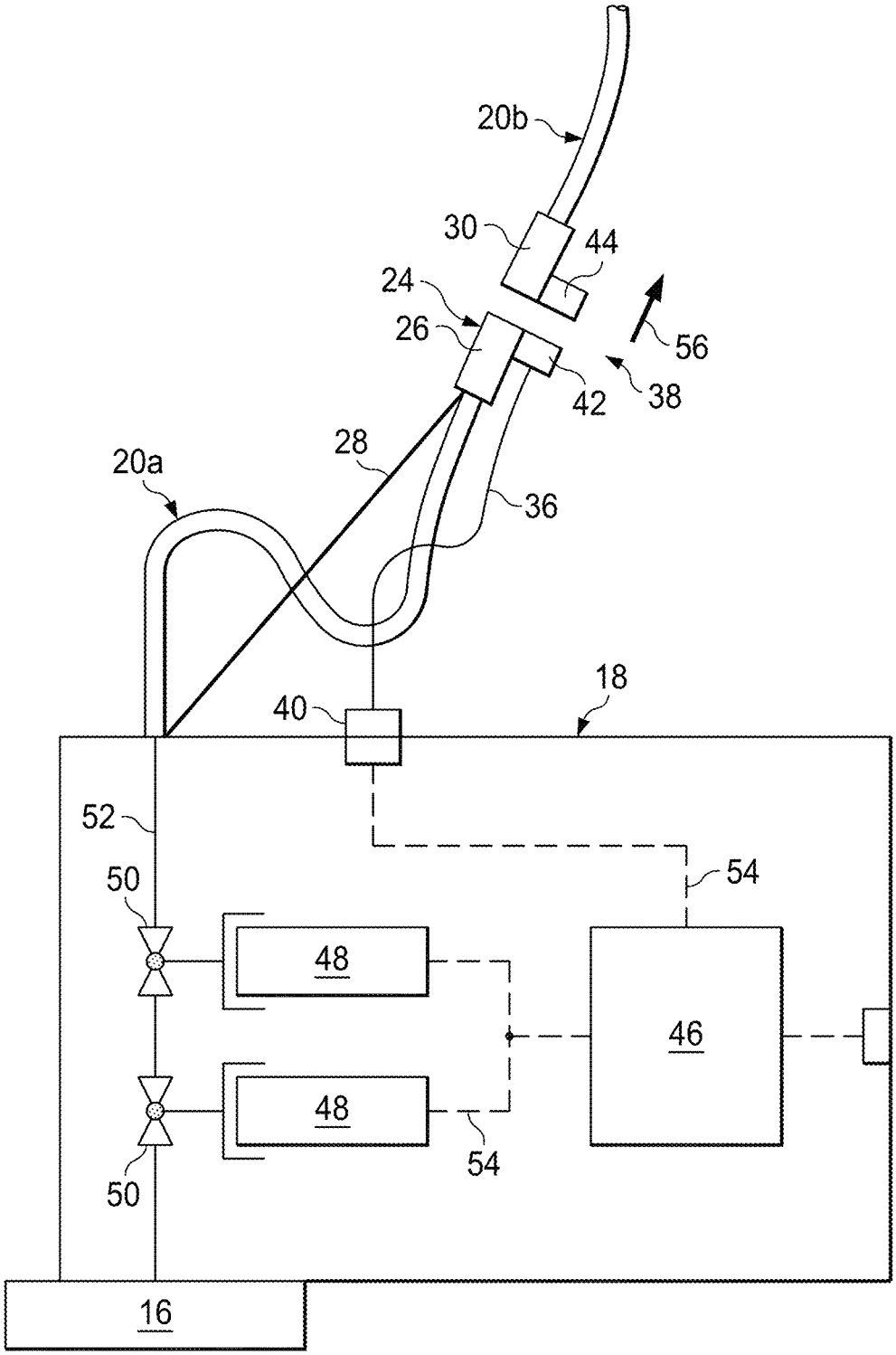
FIG. 2B illustrates a schematic view of the well intervention system of FIG. 2A with the disconnect system in a disconnected state.

As shown in FIGS. 2A and 2B, the disconnect system may include a switch 38 that is connected to and in communication with a disconnect monitor 40 positioned on the safety module 18. In the illustrated embodiment, the switch 38 includes a fixed portion 42 connected to the lower coupling portion 26 and a movable portion 44 connected to the upper coupling portion 30. The switch 38 may be a position switch, a shunt cap, or another type of device. In some embodiments, the switch 38 may be a sensor that detects whether the lower coupling portion 26 and the upper coupling portion 30 are connected to one another.

During operation, the upper coupling portion 30 may become disconnected from the lower coupling portion 26 in response to a predetermined condition (e.g., a tension in the conduit 20*a* exceeding a predetermined threshold, due to drift of the vessel 10, for example). Disconnection between the upper coupling portion 30 and the lower coupling portion 26 interrupts fluid communication between the wellbore 12 and the vessel 10 (FIG. 1). In addition, the movable portion 44 of the switch 38 may be separated from the fixed portion 42. The switch 38 is therefore operable between a first or closed state in which the movable portion 44 and the fixed portion 42 are positioned adjacent one another (i.e., the lower coupling portion 26 and the upper coupling portion 30 remain connected to one another as shown in FIG. 2A), and a second or open state in which the movable portion 44 and the fixed portion 42 are separated (FIG. 2B).

In the embodiment of FIGS. 2A and 2B, the fixed portion 42 of the switch 38 is connected to the disconnect monitor 40 via a monitor tether 36. The monitor tether 36 provides electrical communication between the switch 38 and the disconnect monitor 40, permitting the disconnect monitor 40 to detect whether the switch 38 is in the closed state or the open state (and thus whether the coupling portions 26, 30 are disconnected). For example, the monitor tether 36 may be provided in the form of two or more insulated electrical cables bound together and configured to facilitate the flow of signals and/or current. The disconnect monitor 40 may communicate the state of the switch 38 to another component (e.g., the safety module 18, a remote vehicle 32 (FIG. 1)). The monitor tether 36 may be longer than the mechanical tether 28, and the monitor tether 36 may remain in a slackened condition even while the mechanical tether 28 is taut. The monitor tether 36 may not be subject to large loads. Nonetheless, in some embodiments, the monitor tether 36 may be mechanically reinforced or strengthened.

The safety module 18 may take corrective action in response to a signal from the disconnect monitor 40 indicating that a disconnect event has occurred. In some embodiments, a control system 46 within the safety module 18 may receive signals from the disconnect monitor 40 (or the disconnect monitor 40 may permit the transmission of signals and current between the switch 38 and the control system 46). The control system 46 may be configured to take corrective action in response to one or more signals from the switch 38 by operating one or more actuators 48 to close one or more valves 50 positioned along a flowline 52 that extends through the safety module 18 and provides fluid communication between the tree 16 and the primary conduit 20*a*. In this way, the safety module 18 may seal the tree 16 and interrupt flow into or out of the wellbore 12 (FIG. 1). One or more lines 54 may supply power to and/or may facilitate electrical communication between the disconnect monitor 40, the control system 46, the actuators 48, and the valves 50. Alternatively, the safety module 18 may take corrective action in another manner.

In the embodiment depicted in FIGS. 2A and 2B, the disconnect monitor 40 is positioned between the switch 38 and the control system 46 and is configured to provide continuity between the switch 38 and the control system 46. This facilitates convenient replacement or maintenance of the monitor tether 36 in the event that the monitor tether 36 is damaged. However, in other embodiments, the disconnect monitor 40 may be omitted and the monitor tether 36 may be a fixed cable (e.g., fixedly coupled to the safety module 18) directly connected to and in communication with the line 54 connected to the control system 46.

As shown in FIG. 2A, while the switch 38 is in the closed state, the fixed portion 42 and movable portion 44 may be in close proximity (e.g., in contact with one another) such that a closed circuit is formed and an electric current passes continuously through the switch 38. The disconnect monitor 40 may be configured to detect the presence or absence of the electric current within the switch 38. In the illustrated embodiment, the control system 46 determines that the coupling portions 26, 30 remain coupled to one another as long as electric current is detected passing through the switch 38.

On the other hand, as shown in FIG. 2B, when a disconnect event occurs, the upper coupling portion 30 may pull the movable portion 44 of the switch 38 away from the fixed portion 42 (e.g., in the direction 56), thereby moving the switch 38 to the open state and opening the circuit. Thus, the flow of electric current through the switch 38 may cease and the disconnect monitor 40 detects the difference in the current (e.g., a reduced current or absence of current). Accordingly, the control system 46 determines that the coupling portions 26, 30 are disconnected from one another. Providing consistent electrical connection or communication between the coupling portions 26, 30 and the safety module 18 via the monitor tether 36 facilitates constant monitoring of the disconnect system 24 and more responsive (e.g., automatic) shutdown of flow through the tree 16, safety module 18, and/or conduits 20 when a disconnect event occurs.

The disconnect system may be integrated in an operation in which fluid is directly injected into the well through the tree. In other embodiments, the disconnect system may be integrated in an operation in which fluid is injected into the well via a jumper coupling.

Figure 3A:
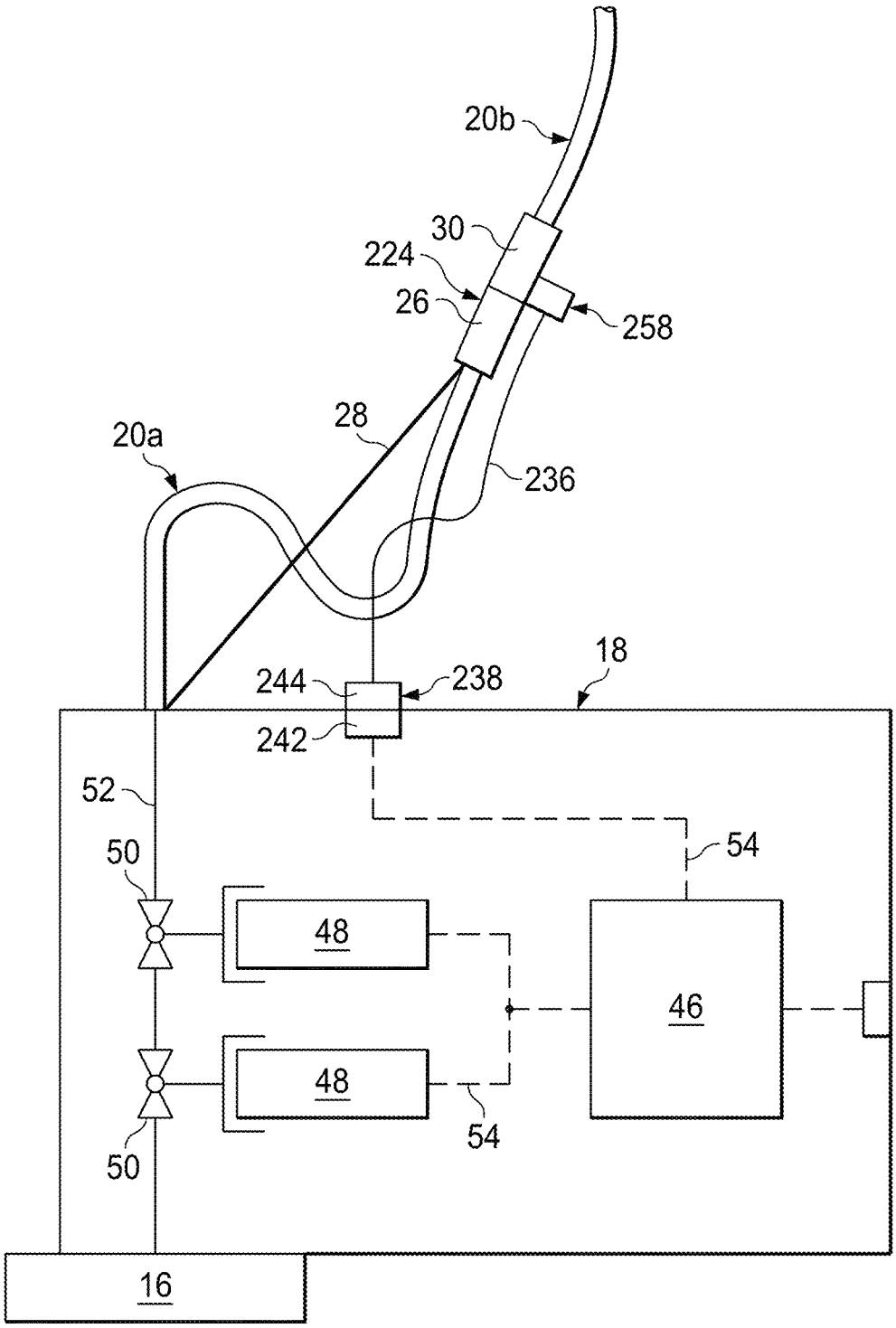
FIG. 3A illustrates a schematic view of a well intervention system according to another embodiment, with a disconnect system in a connected state.
Figure 3B:
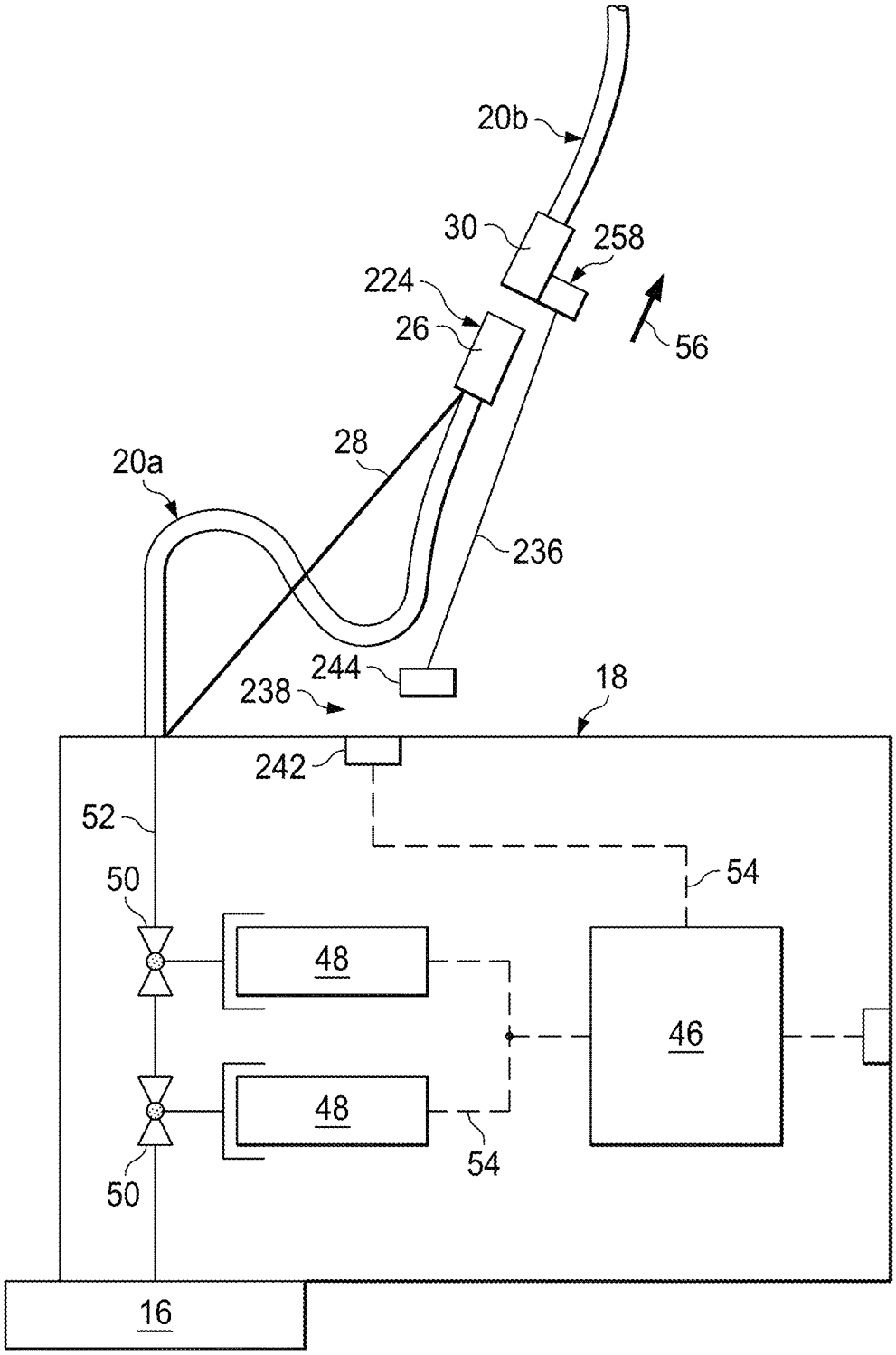
FIG. 3B illustrates a schematic view of the well intervention system of FIG. 3A with the disconnect system in a disconnected state.

FIGS. 3A and 3B illustrate a disconnect system 224 according to another embodiment. The disconnect system 224 includes several of the same components as the disconnect system 24. Components of the disconnect system 224 and components of the disconnect system 24 having similar names and reference numbers with a difference of 200 may be substantially similar in form and function. The disconnect system 224 of FIGS. 3A and 3B is substantially similar to the disconnect system 24, except that a switch 238 is positioned on the safety module 18. A fixed portion 242 of the switch 238 may be positioned on or inside the safety module 18, and a movable portion 244 may be releasably connected thereto. The movable portion 244 may be connected to the fixed portion 242 while the switch 238 is in the closed state (FIG. 3A) and the movable portion 244 may be disconnected from the fixed portion 242 when the switch 238 is in the open state (FIG. 3B). A monitor tether 236 may be connected to the movable portion 244 at one end and to the upper coupling portion 30 at another end (e.g., via an attachment member 258).

While the switch 238 is in the closed configuration, a closed circuit is provided and a current passes through the monitor tether 236 and between the fixed portion 242 and the movable portion 244. The presence or absence of current passing between the fixed portion 242 and the movable portion 244 is detected and communicated to the control system 46 (e.g., via lines 54). If, for example, the primary conduit 20*a* is placed under an excessive tension or exceeds another threshold condition, a disconnect event occurs and the upper coupling portion 30 separates from the lower coupling portion 26. As the upper coupling portion 30 moves (e.g., in the direction 56 shown in FIG. 3B), the monitor tether 236 becomes taut and pulls the movable portion 244 of the switch 238 out of contact with the fixed portion 242, thereby transitioning the switch 238 to the open state and terminating the current running between the fixed portion 242 and the movable portion 244. In response to detecting a change in current (e.g., a reduction and/or absence of current), the control system 46 determines that a disconnect event has occurred and shuts off the flowline 52 (e.g., by closing the valves 50 via the actuators 48).

Figure 4:
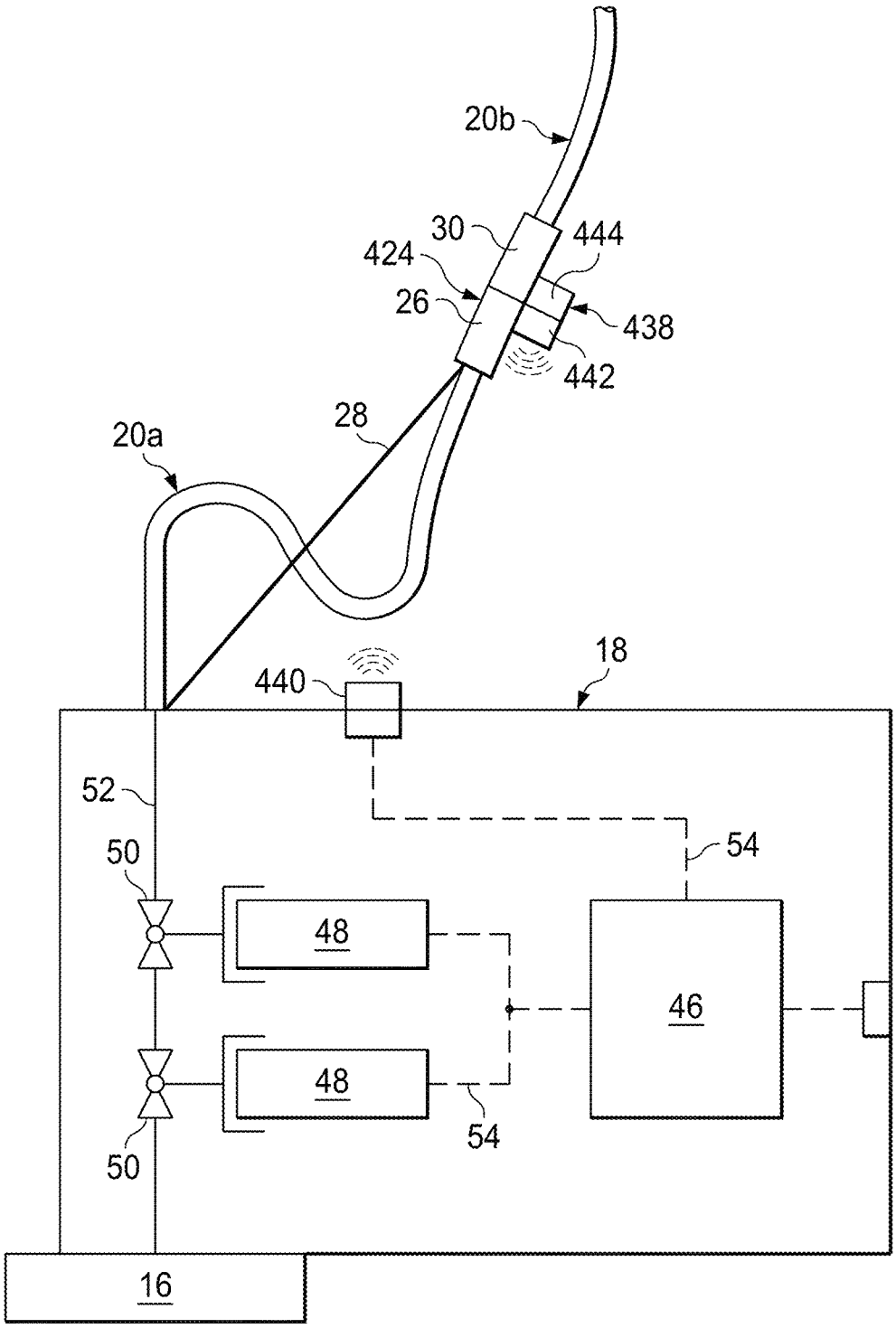
FIG. 4 illustrates a schematic view of a well intervention system according to another embodiment, with a disconnect system in a connected state.

FIG. 4 illustrates a disconnect system 424 according to another embodiment. The disconnect system 424 includes several of the same components as the disconnect system 24. Components of the disconnect system 424 and components of the disconnect system 24 having similar names and reference numbers with a difference of 400 may be substantially similar in form and function. The disconnect system 424 of FIG. 4 is substantially similar to the disconnect system 24, except that communication between a sensor 438 and a safety module 18 is wireless. For example, the sensor 438 may be configured to send electronic signals to the safety module 18 using wireless communication protocols including Wi-Fi, Bluetooth, subsea acoustics, near field communication (NFC), Zigbee, cellular networks, LoRa, and the like. The sensor 438 may be configured to send wireless signals to the safety module 18. In the illustrated embodiment, the sensor 438 communicates with a disconnect monitor 440. In other embodiments, the sensor 438 may communicate wirelessly with the safety module 18 directly (e.g., by sending signals directly to the control system 46).

The sensor 438 may include a switch. While the coupling portions 26, 30 are connected to one another, the switch is in the closed configuration and a closed circuit is provided between a fixed portion 442 of the switch and a movable portion 444 of the switch. When a disconnect event occurs, the switch transitions to an open state and the circuit is broken, triggering a change in the wireless signal transmitted from the sensor 438. The control system 46 (e.g., via the disconnect monitor 440) detects the change in signal. When the control system 46 detects a change that is indicative of a disconnection, the control system 46 determines that a disconnect event has occurred and shuts off the flowline 52 (e.g., by closing the valves 50 via the actuators 48).

Figure 5A:
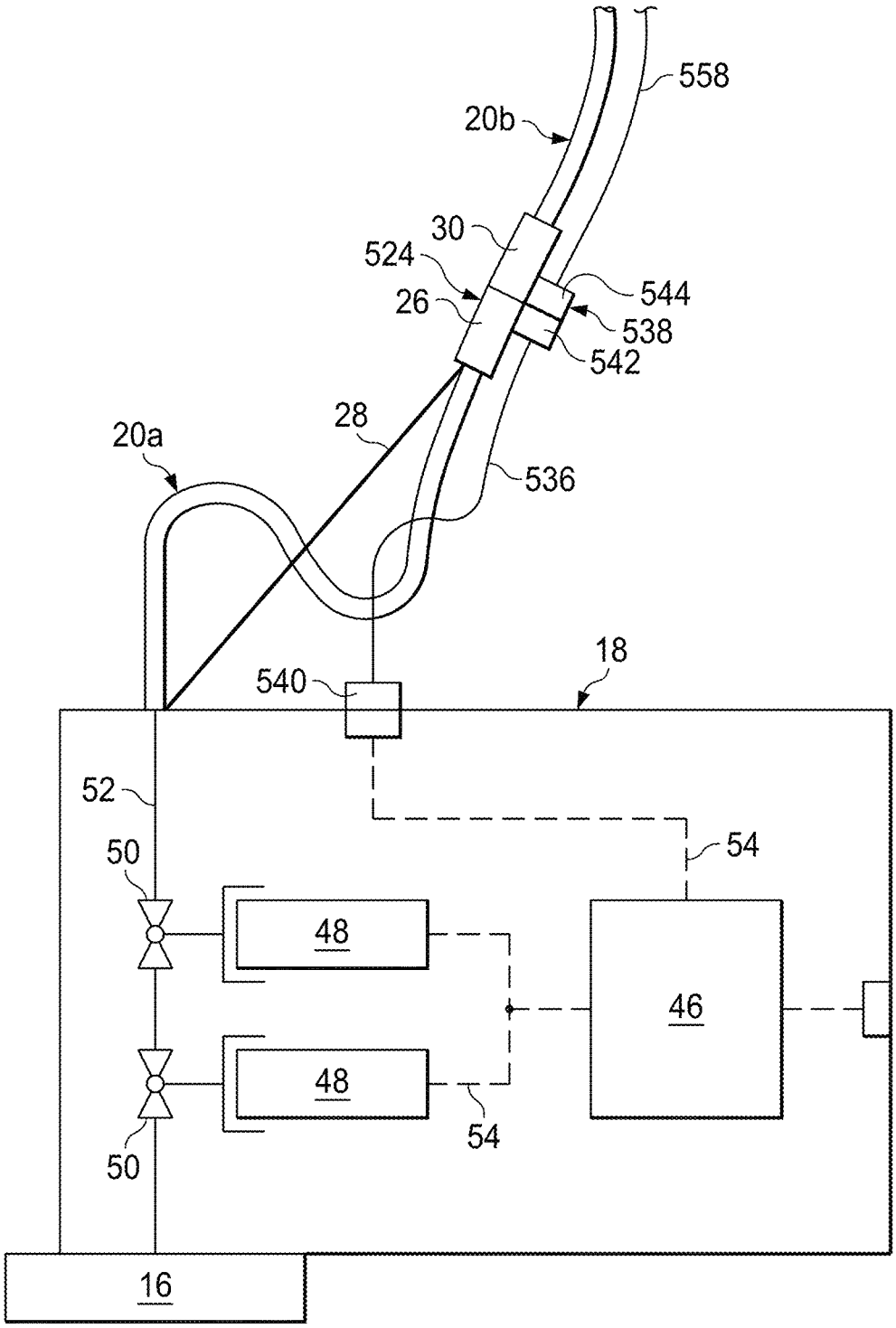
FIG. 5A illustrates a schematic view of a well intervention system according to another embodiment, with a disconnect system in a connected state.
Figure 5B:
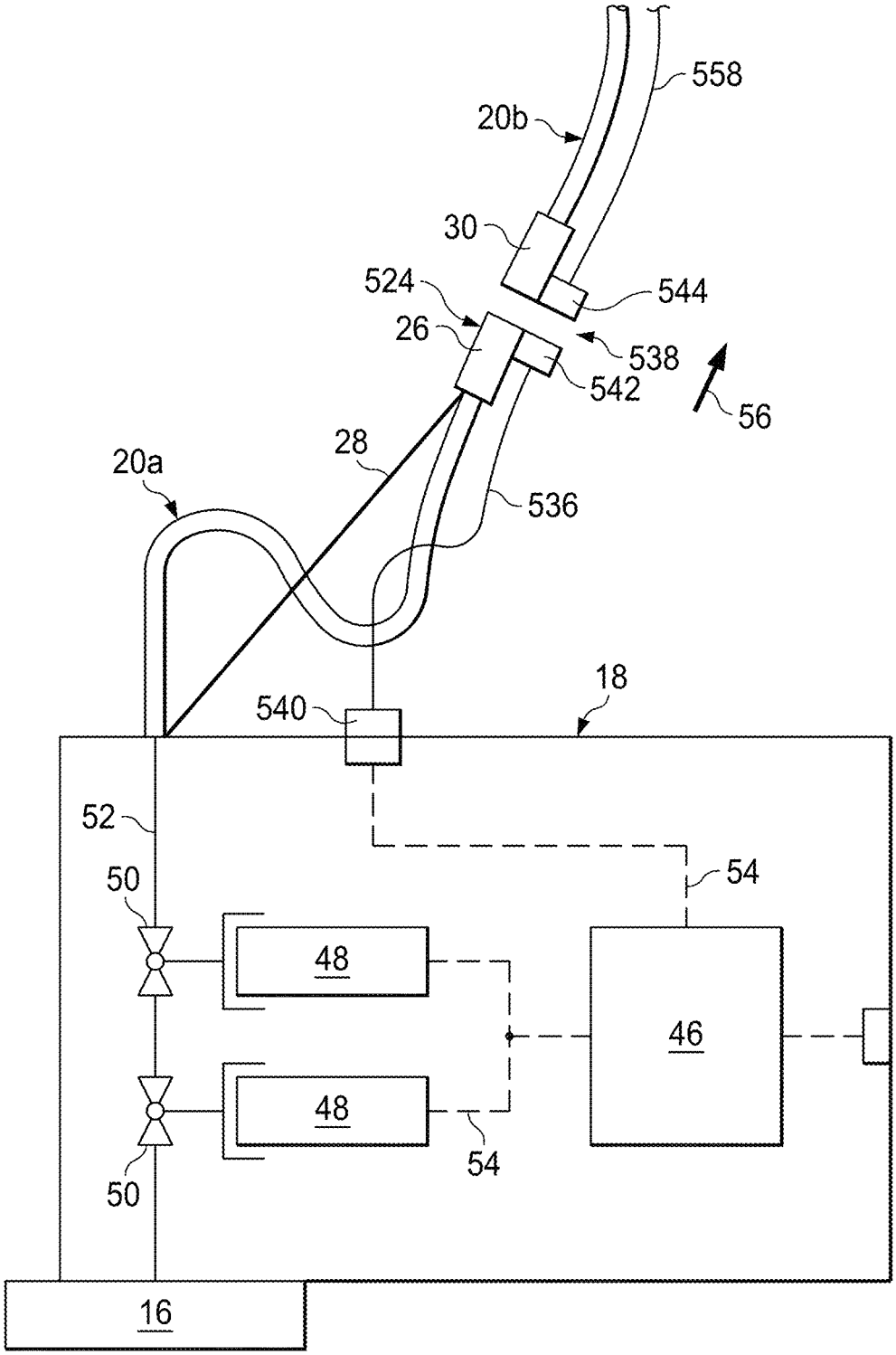
FIG. 5B illustrates a schematic view of the well intervention system of FIG. 5A with the disconnect system in a disconnected state.

FIGS. 5A and 5B illustrate a disconnect system 524 according to another embodiment. The disconnect system 524 is substantially similar to the disconnect system 24 depicted in FIGS. 2A and 2B, and like parts with reference numbers having a difference of 500 may be substantially similar in form and function. A control line 558 extends between the disconnect system 524 and the surface or the vessel 10 (FIG. 1). The control line 558 is routed from the surface to the control system 46 via one or both of a disconnect system 524 and a switch 538 so that a disconnect severs power and communication to the control system 46, thereby triggering operation of the actuators 48 to close the valves 50. For example, the control line 558 may be connected in line with the monitor tether 536 such that electrical communication is provided between the control line 558 and the monitor tether 536. In some embodiments, the control line 558 may be connected to the switch 538 (e.g., to the movable portion 544 of the switch 538) such that the control line 558 provides communication between the switch 538 and the surface and the monitor tether 536 provides communication between the control line 558 and the safety module 18. Thus, if a disconnect occurs when the disconnect system 524 is in communication with the surface via the control line 558, the control system 46 may operate the actuators 48 to close the valves 50.

In other embodiments, other configurations are possible. For example, those of skill in the art will recognize, according to the principles and concepts disclosed herein, that various combinations, sub-combinations, and substitutions of the components discussed above can provide a mud pulse telemetry system.

The embodiment(s) described above and illustrated in the figures are presented by way of example only and are not intended as a limitation upon the concepts and principles of the present disclosure. As such, it will be appreciated that variations and modifications to the elements and their configuration and/or arrangement exist within the spirit and scope of one or more independent aspects as described.

What is claimed is:

1. An intervention system for a subsea well operation, the intervention system comprising:

a first coupling portion;

a second coupling portion releasably coupled to the first coupling portion, the first coupling portion and the second coupling portion configured to provide communication between a vessel and a subsea well while the first coupling portion and the second coupling portion are connected to one another;

a monitor tether coupled to one of the first coupling portion and the second coupling portion, the monitor tether configured to transmit an electrical current while the first coupling portion and the second coupling portion are connected to one another; and a control system operable to detect a change in current in the monitor tether indicative of disconnection between the first coupling portion and the second coupling portion, and in response to detecting the change in the current in the monitor tether indicative of the disconnection, interrupt fluid flow relative to the subsea well.

2. The system of claim 1, wherein the control system is configured to be positioned on a subsea safety module, wherein the monitor tether is configured to be coupled between the subsea safety module and the one of the first coupling portion and the second coupling portion.

3. The system of claim 1, further comprising a switch operable between an open state and a closed state, wherein the switch is in the closed state while the first coupling portion and the second coupling portion are connected to one another, and the switch is in the open state while the first coupling portion and the second coupling portion are disconnected from one another, wherein the electrical current is prevented from passing through the monitor tether while the switch is in the open state.

4. The system of claim 3, wherein the switch includes a first switch portion positioned on the first coupling portion and a second switch portion positioned on the second coupling portion, wherein the switch is in the closed state while the first switch portion and the second switch portion are in contact with one another.

5. The system of claim 4, wherein the monitor tether is removably coupled to a portion of the switch.

6. The system of claim 3, wherein the monitor tether is removably coupled to the control system.

7. The system of claim 1, wherein, in response to detecting the change in the current indicative of the disconnection between the first coupling portion and the second coupling portion, the control system is operable to actuate a valve to prevent at least one of flow into the well and flow out of the well.

8. An intervention system for a subsea well operation, the subsea well operation including a conduit providing communication between a surface vessel and a subsea tree, the intervention system comprising:

a releasable coupling configured to selectively interrupt fluid communication in the conduit, the releasable coupling including a first coupling portion and a second coupling portion, the first coupling portion configured to be coupled to a first portion of the conduit, the second coupling portion configured to be coupled to a second portion of the conduit, the second coupling portion movable between a first condition in which the second coupling portion is coupled to the first coupling portion, and a second condition in which the second coupling portion is separated from the first coupling portion; and a sensor for detecting the condition of the releasable coupling, the sensor transmitting a signal indicative of the condition of the second coupling portion, wherein the sensor transmits the signal via wireless communication or transmits the signal via a monitor tether for providing electrical communication between the sensor and a subsea safety module.

9. The system of claim 8, wherein the sensor includes a switch operable between an open state and a closed state, the switch being in the closed state while the first coupling portion and the second coupling portion are connected to one another, and the switch is in the open state while the first coupling portion and the second coupling portion are disconnected from one another.

10. The system of claim 9, wherein the switch includes a first switch portion positioned on the first coupling portion and a second switch portion positioned on the second coupling portion, wherein the switch is in the closed state while the first switch portion and the second switch portion are in contact with one another.

11. The system of claim 8, further comprising a control system operable to determine, based on the signal indicative of the condition of the second coupling portion, whether the second coupling portion is disconnected from the first coupling portion, and in response to determining that the second coupling portion is disconnected from the first coupling portion, interrupt fluid flow through the conduit.

12. The system of claim 8, further comprising a mechanical tether including a first end coupled to the first coupling portion and a second end configured to be coupled to the subsea safety module.

13. An intervention system for a subsea well operation, the subsea well operation including a conduit providing communication between a surface vessel and a subsea tree, the intervention system comprising:

a releasable coupling configured to selectively interrupt fluid communication in the conduit, the releasable coupling including a first coupling portion and a second coupling portion, the first coupling portion configured to be coupled to a first portion of the conduit, the second coupling portion configured to be coupled to a second portion of the conduit, the second coupling portion movable between a first condition in which the second coupling portion is coupled to the first coupling portion, and a second condition in which the second coupling portion is separated from the first coupling portion;

a sensor for detecting the condition of the releasable coupling;

a mechanical tether including a first end coupled to the first coupling portion and a second end configured to be coupled to a subsea safety module; and a monitor tether coupled to one of the first coupling portion and the second coupling portion, the monitor tether configured to transmit an electrical current while the first coupling portion and the second coupling portion are connected to one another.

14. The system of claim 13, wherein the sensor includes a switch operable between an open state and a closed state, the switch being in the closed state while the first coupling portion and the second coupling portion are connected to one another, and the switch is in the open state while the first coupling portion and the second coupling portion are disconnected from one another.

15. The system of claim 14, wherein the switch includes a first switch portion positioned on the first coupling portion and a second switch portion positioned on the second coupling portion, wherein the switch is in the closed state while the first switch portion and the second switch portion are in contact with one another.

16. The system of claim 13, wherein the first coupling portion is positioned on a portion of the conduit coupled to the subsea tree, and the second coupling portion is positioned on a portion of the conduit coupled to the vessel, wherein the monitor tether includes one end coupled to the first coupling portion.

17. The system of claim 13, wherein the first coupling portion is positioned on a portion of the conduit coupled to the subsea tree, and the second coupling portion is positioned on a portion of the conduit coupled to the vessel, wherein the monitor tether includes one end coupled to the second coupling portion, wherein another end of the monitor tether is configured to be removably coupled to the subsea safety module.

18. The system of claim 13, wherein the monitor tether is longer than the mechanical tether.

19. The system of claim 13, wherein a control line is routed from the surface vessel to the subsea tree via the releasable coupling such that, when the second coupling portion moves from the first condition to the second condition, a control system within the subsea tree operates one or more actuators to close off one or more valves.

* * * * *